US008840422B2

(12) United States Patent
Huang

(10) Patent No.: US 8,840,422 B2
(45) Date of Patent: Sep. 23, 2014

(54) PLUG AND JACK SYSTEM AND ELECTRONIC DEVICE USING SAME

(75) Inventor: Xian-Wu Huang, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 192 days.

(21) Appl. No.: 13/488,941

(22) Filed: Jun. 5, 2012

(65) Prior Publication Data

US 2013/0029512 A1 Jan. 31, 2013

(30) Foreign Application Priority Data

Jul. 29, 2011 (CN) ..... 2011 1 0215432

(51) Int. Cl.
*H01R 13/627* (2006.01)
*H01R 13/639* (2006.01)
*H01R 12/71* (2011.01)

(52) U.S. Cl.
CPC ..... *H01R 13/639* (2013.01); *H01R 12/716* (2013.01)
USPC ..... 439/362

(58) Field of Classification Search
USPC ..... 439/364, 362, 359
See application file for complete search history.

(56) References Cited

U.S. PATENT DOCUMENTS

| | | | | |
|---|---|---|---|---|
| 4,424,407 | A * | 1/1984 | Barbic | 174/67 |
| 4,712,847 | A * | 12/1987 | Hunter et al. | 439/155 |
| 5,228,867 | A * | 7/1993 | Nagamine | 439/364 |
| 6,716,035 | B2 * | 4/2004 | Haager et al. | 439/64 |
| 7,749,015 | B2 * | 7/2010 | Uchikawa et al. | 439/362 |
| 8,337,241 | B2 * | 12/2012 | Foung | 439/536 |
| 2013/0029512 | A1 * | 1/2013 | Huang | 439/329 |
| 2013/0078844 | A1 * | 3/2013 | Eusterholz et al. | 439/362 |

* cited by examiner

*Primary Examiner* — James Harvey
(74) *Attorney, Agent, or Firm* — Novak Druce Connolly Bove + Quigg LLP

(57) ABSTRACT

An electronic device includes a housing, a circuit board, a display having a plug, a jack defined in the circuit board, a locking plate releasably fixed to the housing. The jack is electrically connected to the plug so the display is electrically connected to the circuit board. After a plug is inserted into the jack, the locking plate is fixed to the housing to impact the plug, thereby preventing the plug from disconnecting from the jack.

8 Claims, 5 Drawing Sheets

PLUG AND JACK SYSTEM AND ELECTRONIC DEVICE USING SAME

BACKGROUND

1. Technical Field

This disclosure relates to plug and jack systems, particularly to a plug and jack system used in an electronic device.

2. Description of Related Art

Electronic devices, such as computers, mobile phones, and personal digital assistants, typically include a display and a circuit board that are required to be electrically connected together by a connection interface to transmit data from the circuit board to the display. For example, the circuit board defines a jack for receiving a plug of the display. However, typical plugs are easily removed out of the jack when the electronic device is dropped and encounters shock or impact, making the plug disconnect from the circuit board and further cause interruptions to data transmission. Such interruptions result in inconvenience and data loss in operation, and sometimes damages the connected equipment.

Therefore, there is a room for improved in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the exemplary plug and jack system and an electronic devices using the plug and jack system. Moreover, in the drawings like reference numerals designate their respective parts throughout the several views. Wherever possible, the same reference numbers are used throughout the drawings to refer to the same or like elements of an embodiment.

DETAILED DESCRIPTION

Figure 1:
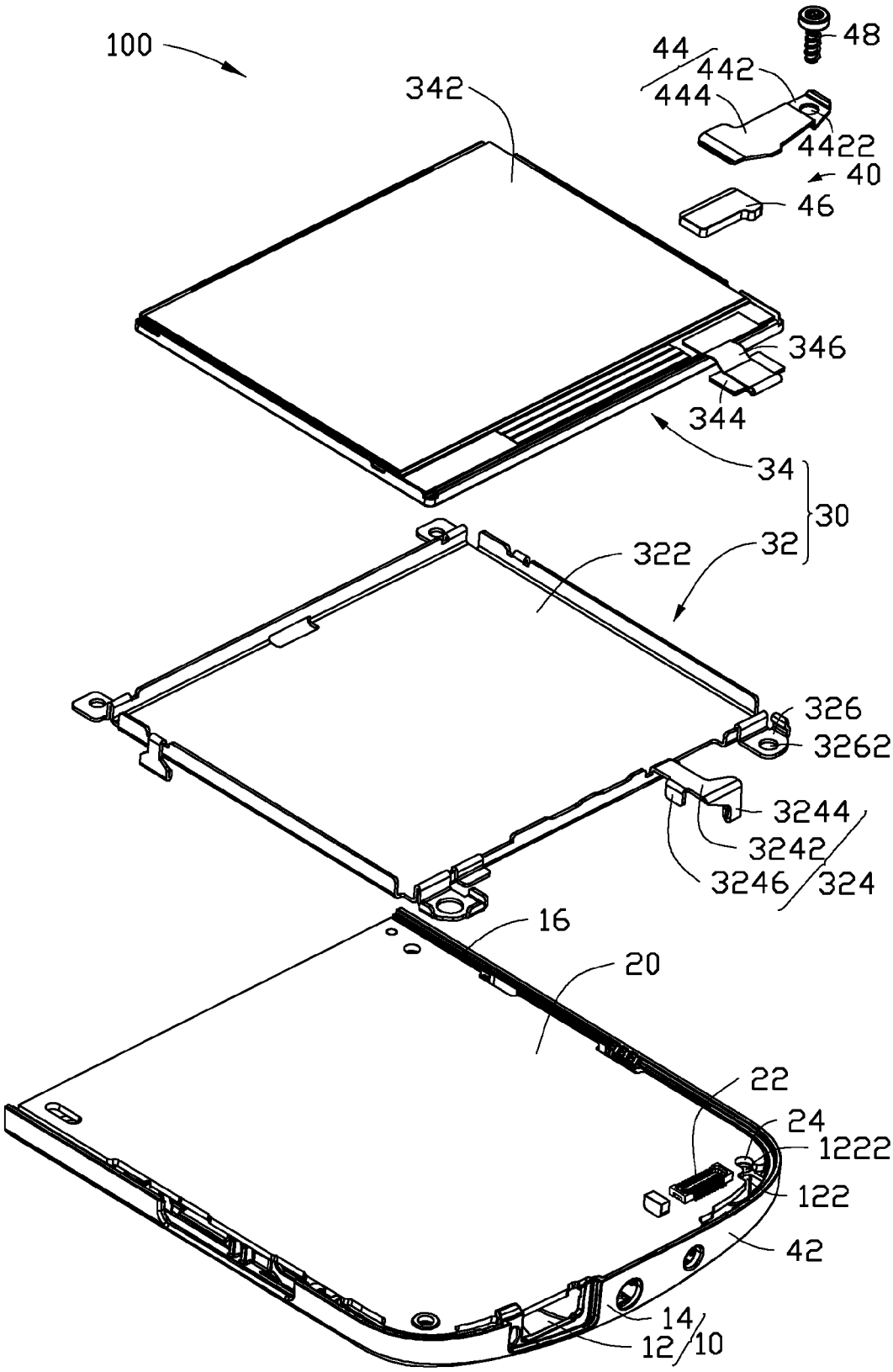
FIG. 1 is an exploded view of an electronic device with an exemplary embodiment of a plug and jack system.

Referring to FIG. 1, an exemplary embodiment of an electronic device 100, such as a mobile phone, includes a housing 10, a circuit board 20, a display 30 and a plug locking device 40.

The housing 10 includes a main portion 12 and an edge 14 protruding from the peripheral edge of main portion 12. The main portion 12 and the edge 14 cooperatively enclose a compartment 16, in which the circuit board 20 and the display 30 are both received. A retaining pole 122 protrudes from the main portion 12, and a first retaining hole 1222 is defined in a distal end of the retaining pole 122.

The circuit board 20 defines a jack 22 for electrically connecting the display 30 with the circuit board 20. The circuit board 20 further defines an opening 24. The display 30 includes a supporting element 32 and a display panel 34.

Figure 2:
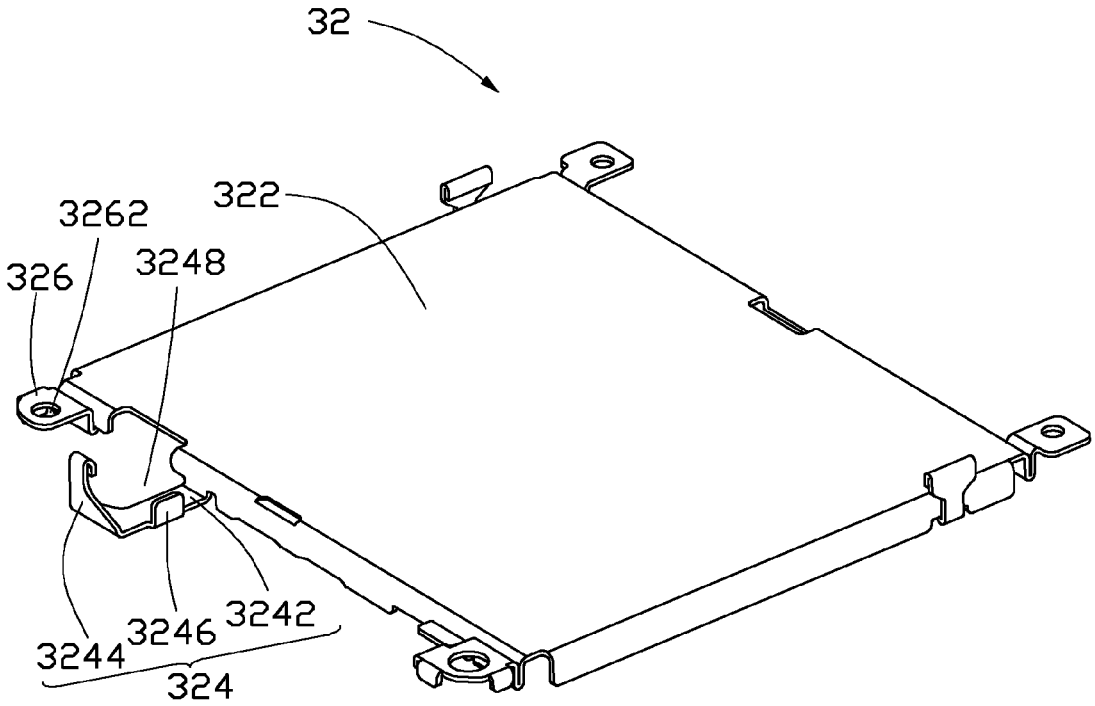
FIG. 2 is an enlarged view of a supporting element of the plug and jack system.

Referring to FIG. 2, the supporting element 32 includes a retaining frame 322, a resisting member 324 protruding from an end of the retaining frame 322, and a retaining member 326 protruding from the end of the retaining frame 322 adjacent to the resisting member 324. The resisting member 324 includes a connecting plate 3242 protruding from the retaining frame 322, a latching block 3244 extending from a distal end of the connecting plate 3242, and a limiting block 3246 extending from a sidewall of the connecting plate 3242 between the latching block 3244 and the retaining frame 322. A receiving space 3248 is surrounded by the connecting plate 3242, the latching block 3244 and the limiting block 3246, for receiving the plug locking device 40. The latching block 3244 is latched to the circuit board 20, to attach the display 30 to the circuit board 20. The limiting block 3246 limits the movement of the plug locking device 40. The retaining member 326 defines a second retaining hole 3262 for attaching the supporting element 32 to the housing 10.

The display panel 34 includes a display body 342, a plug 344 and a flexible circuit board 346 electrically connecting the main portion 12 and the plug 344. The plug 344 is inserted into the jack 22 to electrically connect the display 30 to the circuit board 20.

Figure 3:
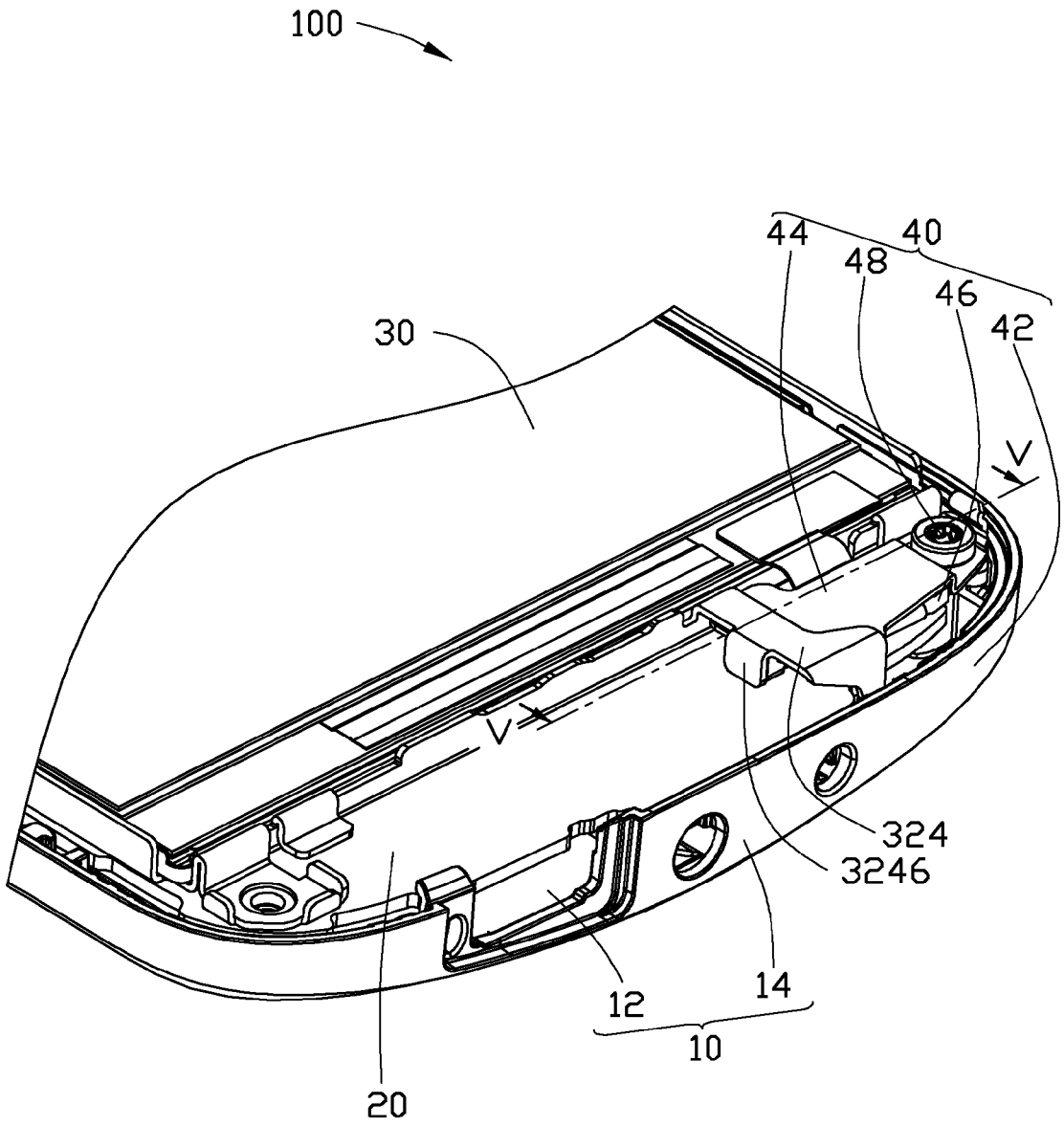
FIG. 3 is an assembled view of the electronic device.

Referring to FIG. 3, the plug locking device 40 includes a main body 42, a locking plate 44 and a buffer 46. In this exemplary embodiment, the main body 42 is a portion of the housing 10, and the first retaining hole 1222 is defined in the main body 42.

The locking plate 44 is made of flexible material, such as a thin piece of steel. The locking plate 44 includes a retaining block 442 and a locking block 444 protruding from the retaining block 442. The retaining block 442 defines a third retaining hole 4422. The buffer 46 is made of soft material, such as foam or rubber. The buffer 46 is attached to a surface of the locking block 444 facing the plug 344, reducing shock when the locking block 444 impacts the plug 344.

The plug locking device 40 further includes a screw 48 inserted into the first retaining hole 1222, the second retaining hole 3262 and the third retaining hole 4422, to attach the locking plate 44 to the main body 42.

Figure 4:
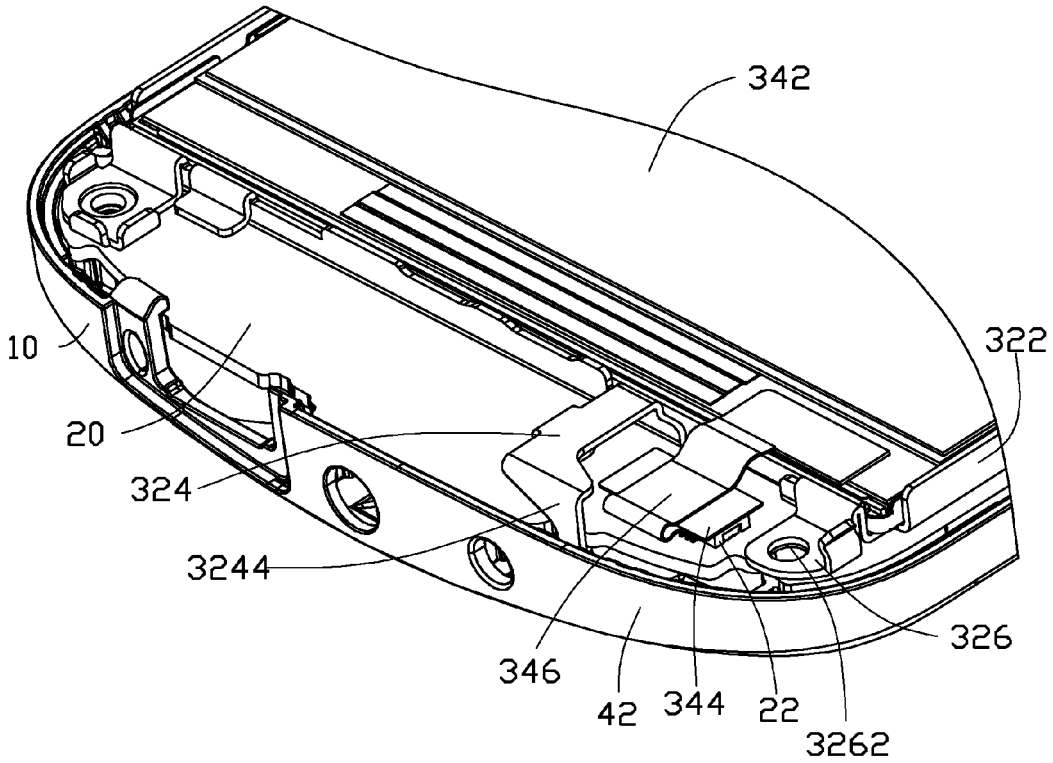
FIG. 4 is similar to FIG. 3, but a locking plate is disassembled from the electronic device.
Figure 5:
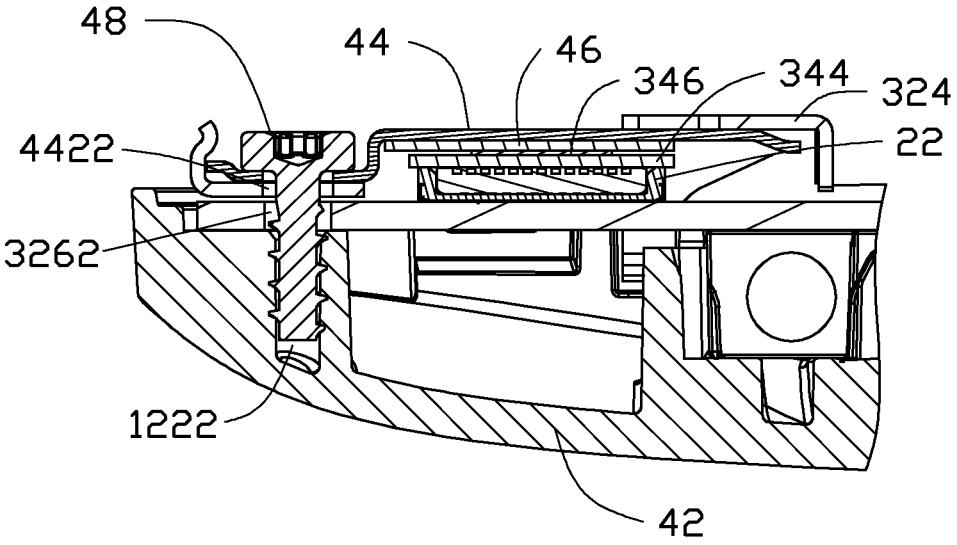
FIG. 5 is a cross sectional view of the electronic device in FIG. 3 along the line V-V.

Referring to FIGS. 4 and 5, in assembly, the display panel 34 is fixed in the retaining frame 322 to form the display 30. The circuit board 20 is fixed in the compartment 16 with the opening 24 aligned with the first retaining hole 1222. The latching block 3244 is latched with the circuit board 20 so the display 30 is attached to the circuit board 20. At this time, the second retaining hole 3262 is aligned with the first retaining hole 1222. The plug 344 is inserted into the jack 22 so the display 30 is electrically connected to the circuit board 20. The buffer 46 is adhered to the locking plate 44. The third retaining hole 4422 is aligned with the second retaining hole 3262. The screw 48 is screwed in the first, second and third retaining holes 1222, 3262, 4422 to fix the locking plate 44 to the main body 42. At this time, the locking plate 44 pushes the buffer 46 to impact on the plug 344, making the plug 344 be firmly inserted in the jack 22, thereby preventing the plug 344 from disconnecting from the circuit board 20.

It is to be further understood that even though numerous characteristics and advantages of the exemplary embodiments have been set forth in the foregoing description, together with details of structures and functions of various embodiments, the disclosure is illustrative only, and changes may be made in detail, especially in matters of shape, size, and arrangement of parts within the principles of the exemplary invention to the full extent indicated by the broad general meaning of the terms in which the appended claims are expressed.

What is claimed is:

1. A plug and jack system comprising:

a housing having main body;

a jack defined in the main body;

a locking plate releasably fixed to the main body; and a buffer;

wherein after a plug is inserted into the jack, the locking plate is fixed to the main body to retain the plug between the locking plate and the jack, and the buffer is located between the plug and the locking plate.

2. An electronic device comprising:

a housing;

a circuit board;

a display having a plug;

a jack defined in the circuit board, the jack being electrically connected to the plug so the display is electrically connected to the circuit board;

a locking plate releasably fixed to the housing; and a buffer;

wherein the locking plate is fixed to the housing to press the plug, and the buffer is located between the plug and the locking plate, thereby preventing the plug from disconnecting from the jack.

3. The plug and jack system of claim 1, wherein the buffer is made of soft material.

4. The plug and jack system of claim 3, wherein the buffer is made of foam or rubber.

5. The plug and jack system of claim 1, further comprising a screw, and the locking plate is fixed to the main body by the screw.

6. The electronic device of claim 2, wherein the buffer is made of soft material.

7. The electronic device of claim 6, wherein the buffer is made of foam or rubber.

8. The electronic device of claim 2, further comprising a screw, and the locking plate is fixed to the main body by the screw.

* * * * *